US006878323B2

(12) United States Patent
Fyfe

(10) Patent No.: US 6,878,323 B2
(45) Date of Patent: Apr. 12, 2005

(54) METHOD OF MANUFACTURING A STAY-IN-PLACE FORM

(76) Inventor: Edward Robert Fyfe, 1339 Ocean Ave., Del Mar, CA (US) 92014

( * ) Notice: Subject to any disclaimer, the term of this patent is extended or adjusted under 35 U.S.C. 154(b) by 387 days.

(21) Appl. No.: 09/920,915

(22) Filed: Aug. 2, 2001

(65) Prior Publication Data

US 2001/0049919 A1 Dec. 13, 2001

Related U.S. Application Data

(62) Division of application No. 09/330,643, filed on Jun. 11, 1999, now Pat. No. 6,295,782.

(51) Int. Cl.[7] ..... B29C 33/38; B29C 41/20; B29C 41/22; B29C 53/60; B29C 53/62

(52) U.S. Cl. ..... 264/135; 264/137; 264/220; 264/221; 264/267; 264/310; 264/317; 264/333; 249/48; 156/184; 156/187; 156/446; 156/457

(58) Field of Search ..... 264/135, 137, 264/220, 221, 267, 310, 317, 333; 249/48; 156/184, 187, 446, 457

(56) References Cited

U.S. PATENT DOCUMENTS

| | | | | | |
|---|---|---|---|---|---|
| 1,853,363 | A | | 4/1932 | Land | 52/359 |
| 1,858,512 | A | * | 5/1932 | Langenberg et al. | 52/721.4 |
| 2,677,165 | A | * | 5/1954 | Copenhaver et al. | 264/31 |
| 2,903,880 | A | | 9/1959 | Johnson | 52/454 |
| 3,010,258 | A | | 11/1961 | Hunter | 52/454 |
| 3,654,018 | A | * | 4/1972 | Bogue et al. | 156/245 |
| 4,105,739 | A | * | 8/1978 | Dave | 264/256 |
| 4,595,168 | A | | 6/1986 | Goodwin | 249/48 |
| 4,629,529 | A | * | 12/1986 | Kadunce | 156/428 |
| 4,694,622 | A | | 9/1987 | Richard | 52/223.5 |
| 4,767,095 | A | | 8/1988 | Fitzgerald et al. | 249/48 |
| 4,786,341 | A | * | 11/1988 | Kobatake et al. | 156/71 |
| 4,900,383 | A | * | 2/1990 | Dursch et al. | 156/184 |
| 4,957,270 | A | | 9/1990 | Rummage et al. | 249/48 |
| 5,022,134 | A | | 6/1991 | George | 29/402.08 |
| 5,043,033 | A | | 8/1991 | Fyfe | 156/71 |
| 5,218,810 | A | | 6/1993 | Isley, Jr. | 52/723.1 |
| 5,271,193 | A | | 12/1993 | Olsen et al. | 52/19 |
| 5,296,187 | A | | 3/1994 | Hackman | 264/257 |
| 5,328,142 | A | * | 7/1994 | Weekers | 249/48 |
| 5,376,316 | A | * | 12/1994 | Weekers | 264/32 |
| 5,447,593 | A | | 9/1995 | Tanaka et al. | 156/307.3 |
| 5,573,348 | A | | 11/1996 | Morgan | 405/52 |
| 5,587,035 | A | * | 12/1996 | Greene | 156/187 |
| 5,599,599 | A | | 2/1997 | Mirmiran et al. | 428/36.3 |
| 5,633,057 | A | | 5/1997 | Fawley | 428/36.1 |
| 5,635,263 | A | | 6/1997 | Saito | 428/40.1 |
| 5,649,398 | A | | 7/1997 | Isley, Jr. et al. | 52/309.17 |
| 5,874,016 | A | * | 2/1999 | Bacon et al. | 249/48 |
| 5,924,262 | A | | 7/1999 | Fawley | 52/721.4 |
| 6,048,594 | A | | 4/2000 | Greene | 428/36.91 |
| 6,123,485 | A | | 9/2000 | Mirmiran et al. | 405/252 |
| 6,189,286 | B1 | | 2/2001 | Seible et al. | 52/721.4 |
| 6,295,782 | B1 | | 10/2001 | Fyfe | 52/721.4 |

* cited by examiner

*Primary Examiner*—Michael P. Colaianni
*Assistant Examiner*—Michael I. Poe
(74) *Attorney, Agent, or Firm*—DLA Piper Rudnick Gray Cary US LLP

(57) ABSTRACT

A stay-in-place method of manufacturing a composite form that is used to provide a strong and durable concrete structure. The form includes a composite shell having an inner wall surface defining an enclosure into which concrete may be poured and allowed to harden. The composite shell may be made of one or several layers of fabric having a resin matrix impregnated therein. The concrete hardens to form a concrete core within the enclosure and a liner is affixed to the inner wall surface of the composite shell to protect the composite shell from alkalinity in the concrete core. The liner includes at least one sheet of a water-impermeable material to protect the concrete core from water and other corrosive elements. The fabric layers are selected such that the fibers elongate as the concrete is poured into the enclosure due to a weight of the concrete and partially shrink back to compensate for shrinkage of the concrete as the concrete dries to form the concrete core. Such stay-in-place composite form can be used in prefabricated form to strengthen new constructions.

13 Claims, 9 Drawing Sheets

METHOD OF MANUFACTURING A STAY-IN-PLACE FORM

CROSS REFERENCE TO RELATED APPLICATIONS

This application is a divisional of and claims the benefit of U.S. application Ser. No. 09/330,643, filed Jun. 11, 1999, now U.S. Pat. No. 6,295,782, the disclosure of which is incorporated herein by reference.

BACKGROUND OF THE INVENTION

1. Technical Field of the Invention

This invention relates generally to concrete support structures and in particular, to stay-in-place forms (i.e., composite shells) for forming concrete support structures.

2. Description of the Related Art

Concrete columns are commonly used as upright supports for superstructures. Bridge supports, freeway overpass supports, building structural supports and parking structure supports are just a few of the many uses for concrete columns. Other concrete support members such as beams, walls, slabs, girders, struts, braces, etc. are employed to impart strength and stability to a large variety of structures. These concrete support structures exist in a wide variety of shapes. Typically, these concrete support structures have circular, square or rectangular cross-sections. However, numerous other cross-sectional shapes have been used including regular polygonal shapes and irregular cross-sections. The size of the concrete support structures also varies greatly depending upon the intended use. Concrete columns with diameters on the order of 2 to 20 feet and lengths of well over 50 feet are commonly used as bridge or overpass supports.

Conventionally, some concrete columns have been constructed by filling a cylindrical form having a network of rebar mounted therein with a concrete composition, allowing the composition to cure, and removing the form.

Also, in the past, elongate paper fiber tubes have been used to form concrete columns. The tubes are made by spirally winding several layers of strong fiber paper. The spirally wound paper is laminated along its seams with a special adhesive. The outside of the tube can be coated with hot wax for protection against adverse weather conditions. Concrete is poured into the tube and allowed to harden so as to form a column. After hardening, the tube is stripped away from the concrete column and scrapped.

Rather than paper tubes, reusable steel or wood forms can also be used. Concrete is poured into these forms and allowed to harden. After hardening, the form is removed from the concrete structure and can be used again.

All of these conventional concrete support structures are subject to deterioration of their long-term durability and integrity. Permeability of the exposed concrete by water can cause the concrete to deteriorate over time. When moisture is trapped in the concrete and freezes, cracks typically form in the concrete structural members. In addition, some of these conventional concrete support structures are located in earthquake prone areas but do not have adequate metal reinforcement or structural design to withstand high degrees of asymmetric loading.

More recently, composites have been used to repair and retrofit columns, beams, walls, tanks, chimneys and other structural elements. However, a need exists to use composites in a prefabricated form to strengthen new constructions, protect internal reinforcing steel, provide fiber reinforcement outside of a concrete layer, to provide better appearance features, and to solve the above problems.

SUMMARY OF INVENTION

A stay-in-place composite form in accordance with the present invention provides increased strength and durability to concrete support structures. The stay-in-place form can be used in prefabricated form or can be fabricated at the construction site, to strengthen new constructions.

The stay-in-place form includes a composite shell made up of fibrous fabric layers impregnated with a resin matrix. The composite shell has an inner wall surface defining an enclosure into which concrete may be poured and allowed to harden to form a concrete core. As the concrete is poured into the enclosure, the fibers in the fabric material elongate due to the weight of the concrete. Then, as the concrete dries, the fibers partially shrink back to compensate for shrinkage of the concrete.

In one embodiment of the present invention, the percentage of elongation of the resin matrix is greater than the percentage of elongation of the fibers. Typically, the percentage of elongation of the fibers and resin matrix prevents a gap from forming between the concrete core and the composite shell when the concrete shrinks.

A liner made of a water-impermeable material is affixed to the inner wall surface of the composite shell to protect the composite shell from alkalinity or other chemical products in the concrete core. This liner is in direct contact with an outer surface of the concrete core and either completely or partially surrounds the concrete core.

In one embodiment of the present invention, the stay-in-place form is manufactured using a rigid collapsible tubular member. The exterior surface of the tubular member is wrapped with the liner and then the fabric layers impregnated with resin are applied to the liner. Once the fabric layers cure, the tube is collapsed and removed from beneath the liner. What remains is a hollow stay-in-place composite form.

In yet another embodiment of the present invention, the stay-in-place form is manufactured using a mandrel. In such embodiment, the liner is applied to an exterior surface of the mandrel and then the fabric layers impregnated with resin are applied to the liner. Once the fabric layers cure, the liner and harden fabric layers are separated from the mandrel. Again, what remains is a hollow stay-in-place composite form.

In still another embodiment of the present invention, the collapsible tube or the mandrel is rotated about an axis while the fabric layer and the resin matrix is applied to the liner. Such rotation maintains the form of the tube and composite shell, and ensures that the resin is uniformly distributed. The rotation of the tube or mandrel continues until the resin impregnated fabric layers are fully cured.

These and other features and advantages of the present invention will become apparent by reference to the following detailed description and accompanying drawings which set forth several illustrative embodiments in which the principles of the invention are utilized.

DETAILED DESCRIPTION OF THE INVENTION

Stay-In-Place Form

Figure 1:
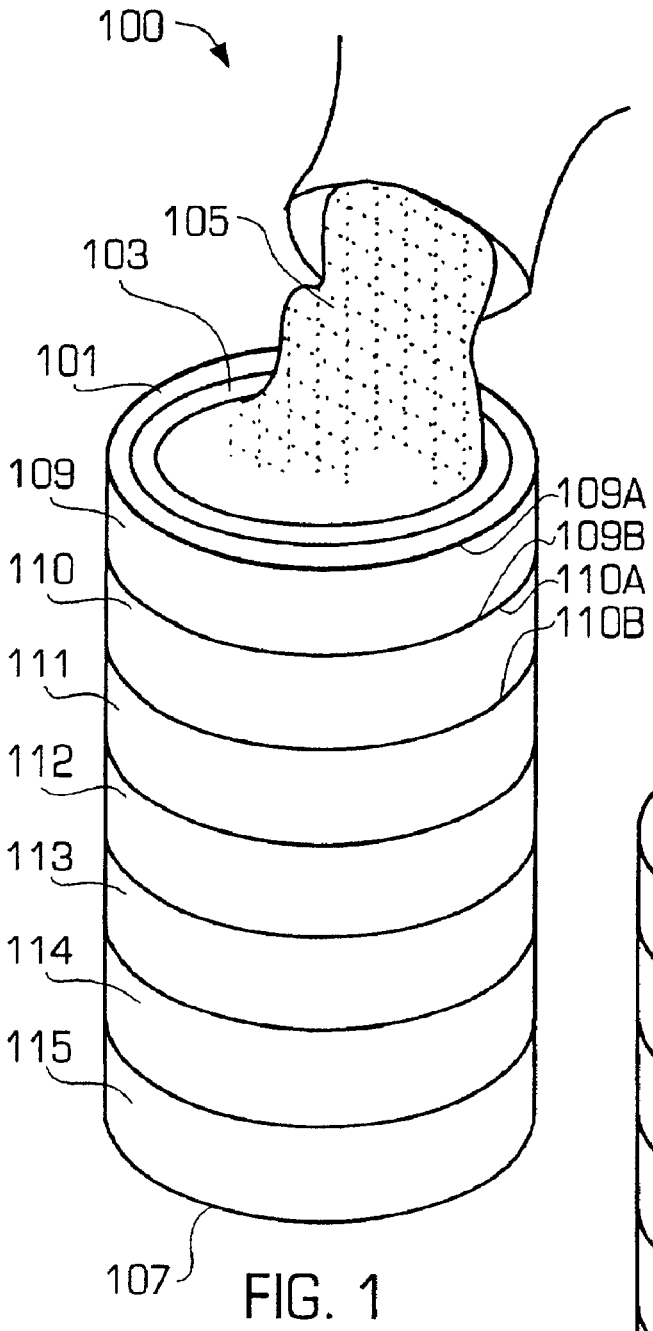
FIG. 1 is a perspective longitudinal view illustrating the stay-in-place form in accordance with the present invention.

Referring to FIG. 1, a perspective view of a stay-in-place form 100 for use as a support structure, such as a column or beam, is shown. Although stay-in-place form 100 is illustrated as an elongate tubular structure in FIG. 1, it will be appreciated that stay-in-place form 100 may be any desired shape, such as rectangular or octagonal. Stay-in-place form 100 includes an exterior composite shell 101 and a liner 103 secured to the inner surface of composite shell 101. In this way, stay-in-place form 100 provides a hollow closed form into which a slurry of concrete or cement material 105 is placed. Slurry 105 fills stay-in-place form 100 and hardens to form a concrete core 205 of a fully reinforced support structure 200, illustrated in FIG. 2.

Composite shell 101 is formed of a resin-impregnated composite reinforcement layer 107, as illustrated in FIG. 1. Composite reinforcement layer 300 is in direct contact with the outer surface of liner 103 and may be made of a single layer of fabric, although typically reinforcement layer 107 is made up of multiple layers of fabric. In the exemplary embodiment illustrated in FIG. 1, composite reinforcement layer 107 is made of seven fabric layers 109–115. Each of fabric layers 109–115 has first and second parallel selvedges. For example, the first and second selvedges for fabric layer 109 are shown at 109A and 109B, respectively. The first and second selvedges for fabric layer 110 are shown at 110A and 110B, respectively. In an exemplary embodiment, the width of the fabric between the selvedges may be from twelve to one hundred inches wide. Fabric layers 109–115 may include a single fabric layer or they may be laminates made up of two or more layers of fabric.

Figure 2:
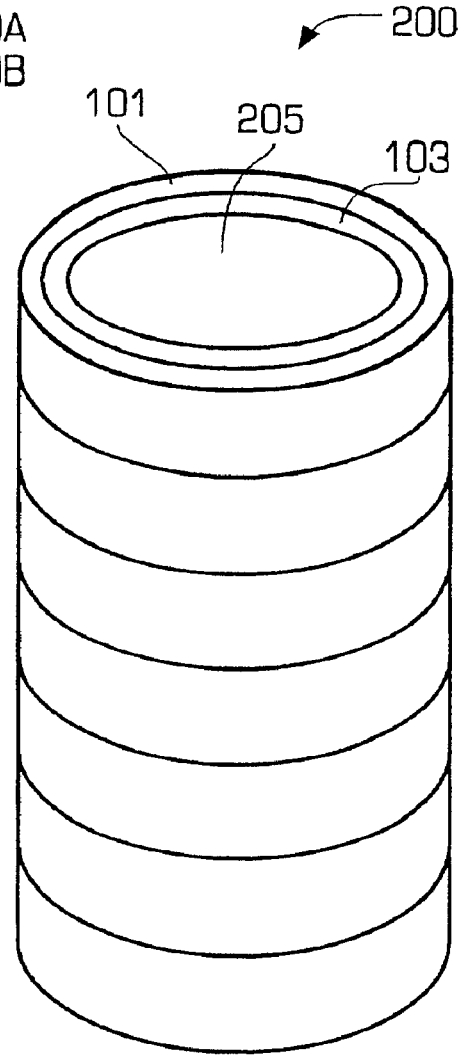
FIG. 2 is a perspective longitudinal view illustrating a fully reinforced support structure using the stay-in-place form of the present invention.
Figure 3:
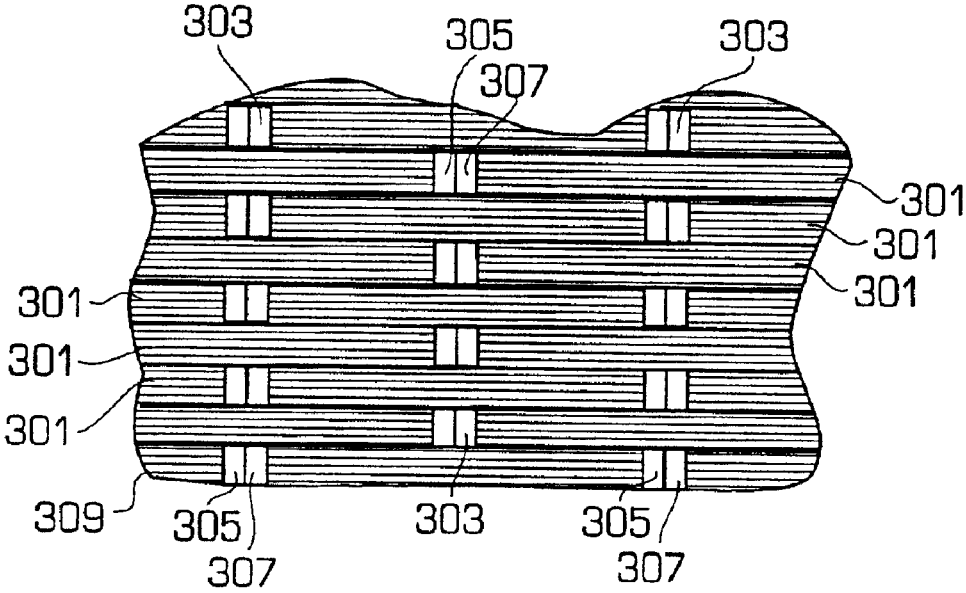
FIG. 3 is a detailed sectional view of an exemplary reinforced composite material in accordance with the present invention.

An exemplary fabric is shown in FIG. 3. The fabric is preferably a plain woven fabric having warp yarns 301 and fill yarns 303. The warp yarns 301 and fill yarns 303 may be made from the same fibers or they may be different. The fabric may be comprised of, for example, glass, carbon, polyaramid, graphite, polyaramid, boron, Kevlar, silica, quartz, ceramic, polyethylene, aramid, or other fibers. A wide variety of types of weaves and fiber orientations may be used in the fabric. Where a single layer of fabric is used, it will often be desirable to use weft cloth containing both horizontal and vertical fibers. For example, composite reinforcement layer 107 may include vertical, horizontal and off-axis fibers which can minimize or eliminate the need for steel reinforcement in support structure 200. Where multiple layers of fabric are used, it will often be desirable to alternate the orientation of the fibers to provide maximum strength along multiple axes. Typically, fibers oriented along the longitudinal axis provide stiffness of composite shell 101 whereas fibers oriented along the horizontal axis provide strength in the hoop direction or along the circumference of composite shell 101. Such strengthening in the hoop direction prevents buckling of the longitudinal fibers and restricts the movement of concrete core 205 of support structure 200 in FIG. 2.

Referring again to FIG. 3, the warp yarns 301 are preferably made from glass. The fill yams 303 are preferably a combination of glass fibers 305 and polyaramid fibers 307. The diameters of the glass and polyaramid fibers preferably range from about 3 microns to about 30 microns. It is preferred that each glass yarn include between about 200 to 8,000 fibers. The fabric is preferably a plain woven fabric, but may also be a 2 to 8 harness satin weave. The number of warp yarns per inch is preferably between about 5 to 20. The preferred number of fill yarns per inch is preferably between about 0.5 and 5.0. The warp yarns extend substantially parallel to the selvedge 309 with the fill yarns extending substantially perpendicular to the selvedge 309 and substantially parallel to the axis of the stay-in-place form 100. This particular fabric weave configuration provides reinforcement in both longitudinal and axial directions. This configuration is believed to be effective in reinforcing the stay-in-place form 100 against asymmetric loads experienced by the support structure 200 of FIG. 2, during an earthquake.

Figure 4:
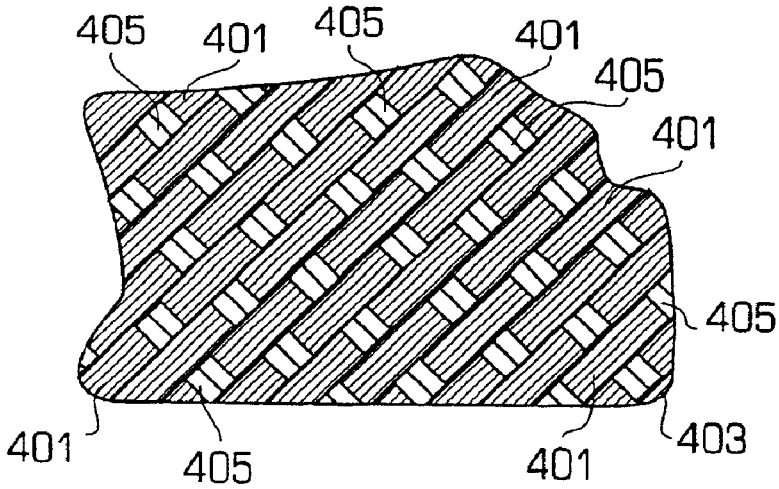
FIG. 4 is a detailed sectional view of an alternative exemplary reinforced composite material in accordance with the present invention.

A preferred alternate fabric pattern is shown in FIG. 4. In this fabric pattern, plus bias angle yarns 401 extend at an angle of between about 20 to 70 degrees relative to the selvedge 403 of the fabric. The preferred angle is 45 degrees relative to the selvedge 403. The plus bias angle yarns 401 are preferably made from yarn material the same as described in connection with the fabric shown in FIG. 3. Minus bias angle yarns 405 extend at an angle of between about −20 to −70 degrees relative to the selvedge 403. The minus bias angle yarns 405 are preferably substantially perpendicular to the plus bias angle yarns 401. The bias yarns 401 and 403 are preferably composed of the same yarn material. The number of yarns per inch for both the plus and minus bias angle is preferably between about 5 and 30 with about 10 yarns per inch being particularly preferred.

Figure 5:
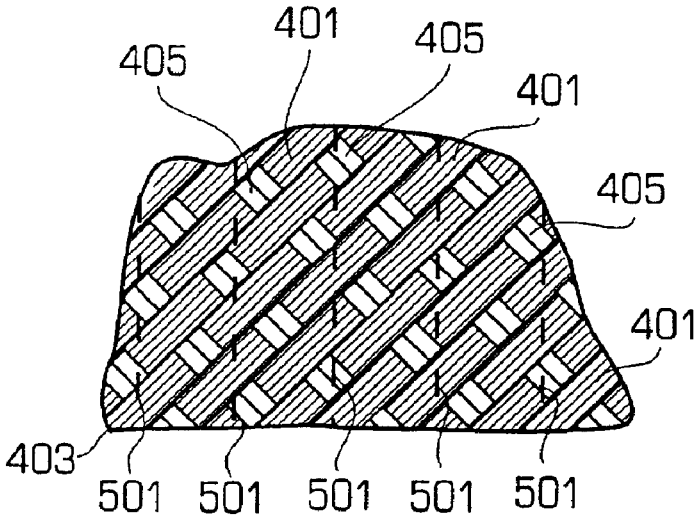
FIG. 5 depicts a weave pattern which is the same as the weave pattern shown in FIG. 4 except that the yarns are stitch bonded together.

It is preferred that the fabric weave patterns be held securely in place relative to each other. This is preferably accomplished by stitch bonding the yarns together as shown in FIG. 5. An alternate method of holding the yarns in place is by the use of adhesive or leno weaving processes, both of which are well known to those skilled in the art. In FIG. 5, exemplary yarns used to provide the stitch bonding are shown in phantom at 501. The process by which the yarns are stitch bonded together is conventional and will not be described in detail. The smaller yarns used to provide the stitch bonding may be made from the same materials as the principal yarns or from any other suitable material commonly used to stitch bond fabric yarns together. The fabric shown in FIG. 3 may be stitch bonded. Also, if desired, unidirectional fabric which is stitch bonded may be used in accordance with the present invention.

Figure 6:
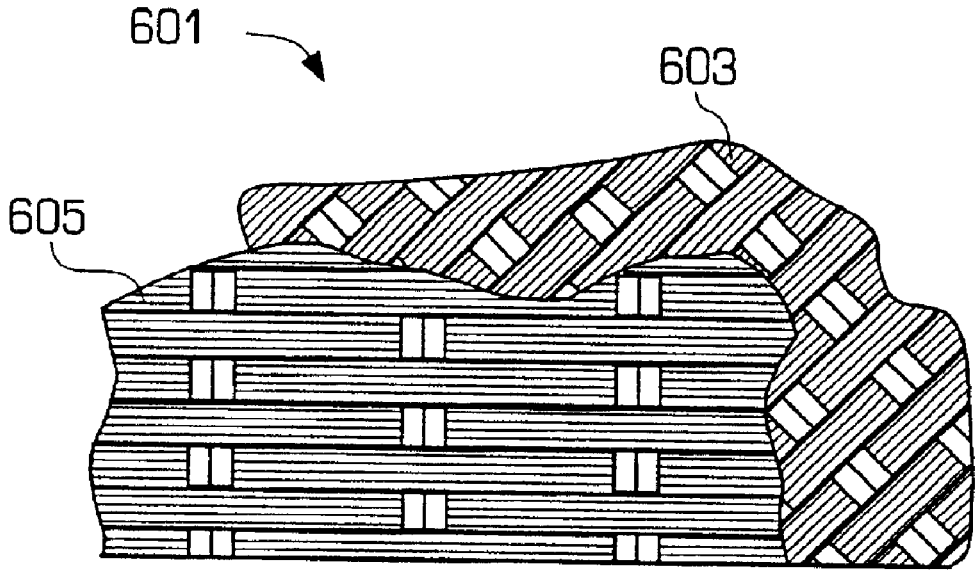
FIG. 6 is a detailed partial section of the face of an external surface of composite shell covered with multiple fabric layers.

In FIG. 6, a portion of a composite reinforcement layer surrounding a concrete column is shown generally at 601. The composite reinforcement layer 601 includes an interior fabric layer 603 which is the same as the fabric layer shown in FIG. 5. In addition, an exterior fabric layer 605 is provided which is the same as the fabric layer shown in FIG. 3. This dual fabric layer composite reinforcement 601 provides added structural strength when desired.

In another embodiment, the composite reinforcement layer 107 of FIG. 1 may have an inner layer of longitudinal axial fibers and an outer layer of circumferential hoop fibers. For example, the multilayer reinforcement material 107 may include a first reinforcement layer including two fabric layers of glass or carbon fibers in a longitudinal direction and a second high strength composite reinforcement layer including three layers of glass or carbon fibers in the hoop direction. In another embodiment, the high strength composite reinforcement layers have spiral layers. These fabric layers not only provide the structural integrity of the composite shell 101, but also provide significant reinforcement against externally applied forces.

All of the fabric layers 109–115 must be impregnated with a resin in order to function properly in accordance with the present invention. Suitable resins for use in accordance with the present invention include polyester, epoxy, polyamide, bismaleimide, vinylester, urethanes and polyurea. Other impregnating resins may be utilized provided that they have the same degree of strength and toughness provided by the previously listed resins. Epoxy based resin systems are preferred. It is also preferred that the fiber and resin matrix are waterproof.

Referring again to FIG. 1, when slurry 105 is poured into stay-in-place form, the weight of slurry 105 elongates or stretches the fibers in reinforcement layer 107 causing these fibers to be stressed. Thus, liner 103, reinforcement layer 107, and the resin impregnated into reinforcement layer 107 are selected to permit elongation of the fibers when slurry 105 is poured into stay-in-place form 100. In particular, the resin must be flexible enough to allow for such post-tensioning of the fibers. Having been elongated during the pouring of concrete 105, the fibers are stressed, which strengthens the fibers and allows for reduced thickness of stay-in-place form 100. These fibers will then partially shrink back or relax to compensate for concrete shrinkage as concrete slurry 105 dries. As a result, the final percent of elongation of the resin should be greater than percent of elongation of the fibers so that the reinforcement layer 107 does not crack from stress caused by the weight of the concrete. For example, in one embodiment the glass fibers have 2% elongation and the epoxy has 3–4% elongation. The percent of elongation of the resin should be balanced with the percent of elongation of the fibers so that there is some stress on the fibers from the weight of the concrete, but not so much so that there is cracking. With such a balance, the fibers are able to shrink back to compensate for concrete shrinkage once slurry 105 hardens without leaving any gaps between concrete core 205 and liner 103 of support structure 200, illustrated in FIG. 2.

Figure 7:
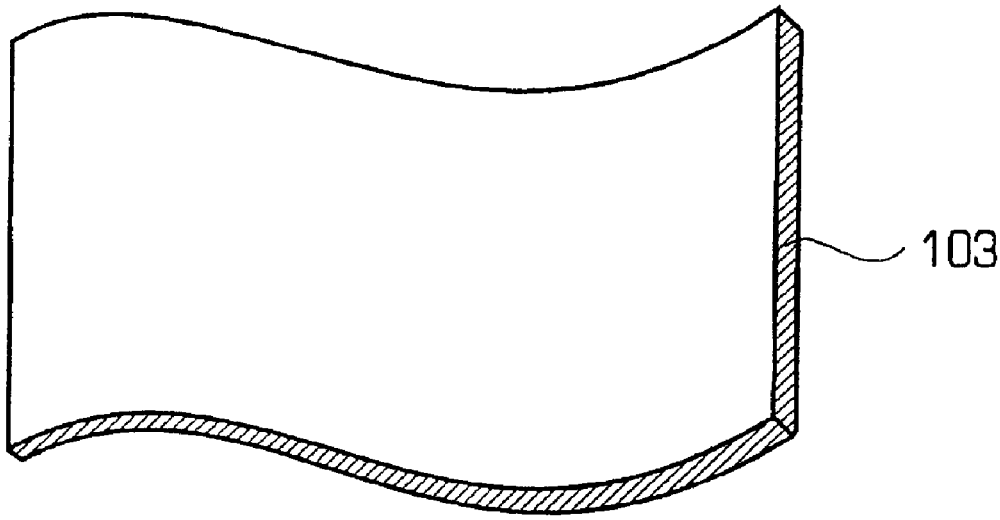
FIG. 7 is a perspective view of a protective liner.

Liner 103 is received to the inner wall surface of hollow composite shell 101. A perspective view of liner 103 is illustrated in FIG. 7. As shown, liner 103 is flexible so that it will conform to the inner wall surface of composite shell 101 regardless of the shape of the shell 101. Referring again to FIG. 2, liner 103 is formed of a water-resistant and impermeable material to protect concrete core 205 from moisture and corrosive materials, as well as to protect the composite shell 101 from the alkalinity in concrete core 205. Liner 103 can be fabricated from plastic or rubber materials such as polystyrene, vinyl, polyethylene, chlorosulfonated polyethylene, neoprene, EPDM (ethylene-propylene-diene terpolymer), rubber, or other resistive materials.

The thickness of liner 103 should be sufficient to prevent damage when slurry 105 is poured into stay-in-place form 100. For example, if liner 103 is too thin, the weight of the slurry 105 may tear liner 103 as it is poured into stay-in-place form 100. In an exemplary embodiment, the thickness of liner 103 is between 1/64 and 1/4 of an inch.

Stay-in-place form 100 is filled with slurry 105 which hardens within stay-in-place form 100 to form a concrete core 205 of structural member 200 shown in FIG. 2, such as a column or beam. Stay-in-place form 100 is not removed from concrete core 205, but rather remains in place to increase the shear strength and longevity of support structure 200 over that of conventional support structures.

Figure 8:
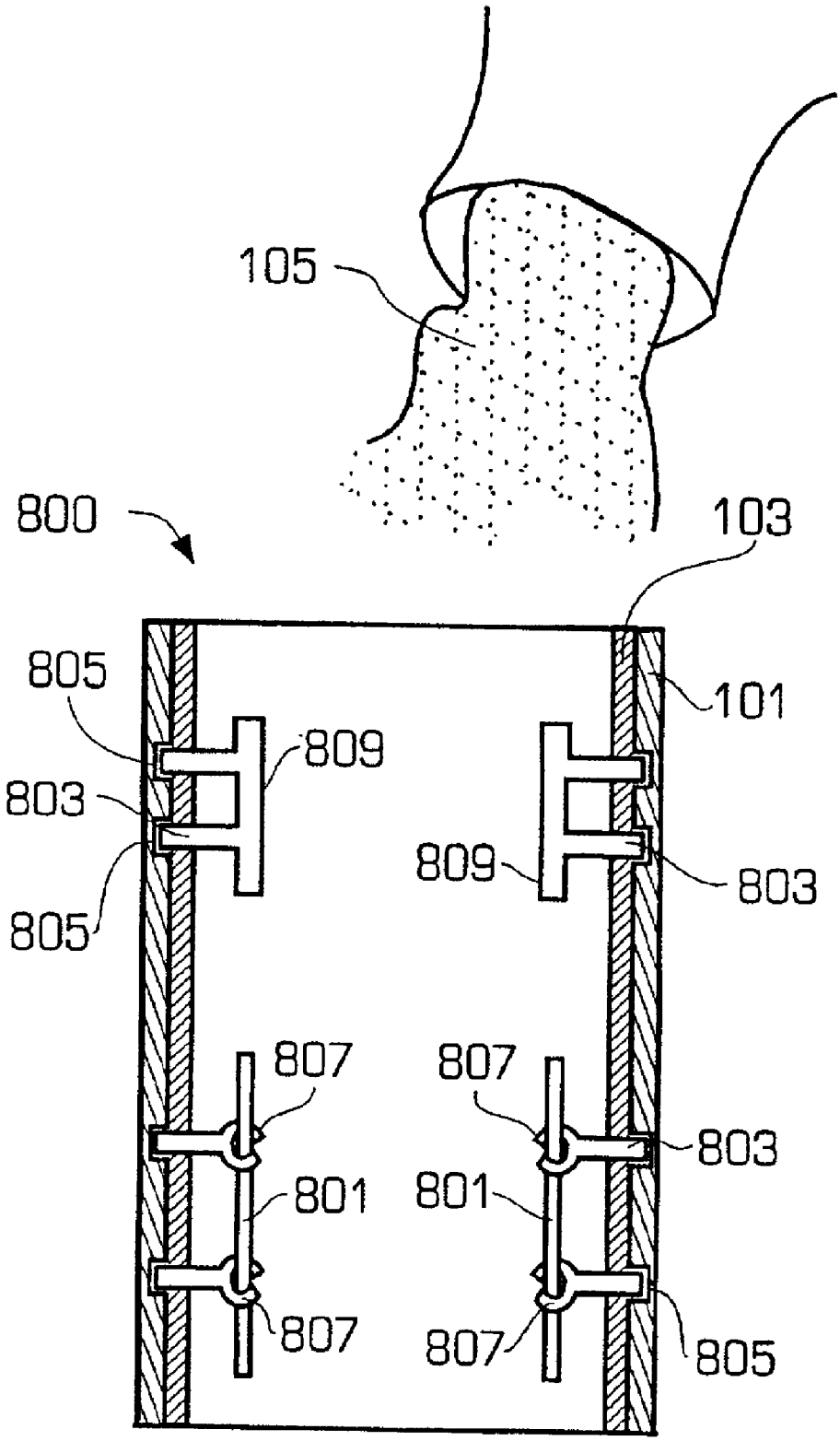
FIG. 8 is a cross-sectional inner view of an alternate embodiment of the stay-in-place-form in accordance with the present invention.

One way to increase the structural integrity of concrete structural member 200, illustrated in FIG. 2, is to attach reinforcing bars to the inner surface of stay-in-place form 100. FIG. 8 illustrates an alternate embodiment of the present invention, in which a cross-section of stay-in-place form 800 is shown with reinforcing bars 801, 809. Stay-in-place form 800 has the same outer composite shell 101 and liner 103, but also has reinforcing bars 801, 809 such as steel or composite reinforcing bars, secured to the inner surface of stay-in-place form 800 to provide further reinforcement.

As shown in FIG. 8, anchors or stiffener tabs 803 are received by grooves 805 and are distributed about the inner wall surface of stay-in-place form 800. These anchors 803 extend horizontally from the inner wall surface of composite shell 101, through liner 103, and terminate within the enclosure of stay-in-place form 800. In one embodiment, anchors 803 terminate in clamps 807 that are used to hold vertically extending reinforcing bars 801. With such configuration, reinforcing bars 801 can be pre-installed at the factory or snapped into clamps 807 at the construction site. In an alternate embodiment, vertically extending reinforcement bars 809 are integrally formed with anchor 805.

Figure 9:
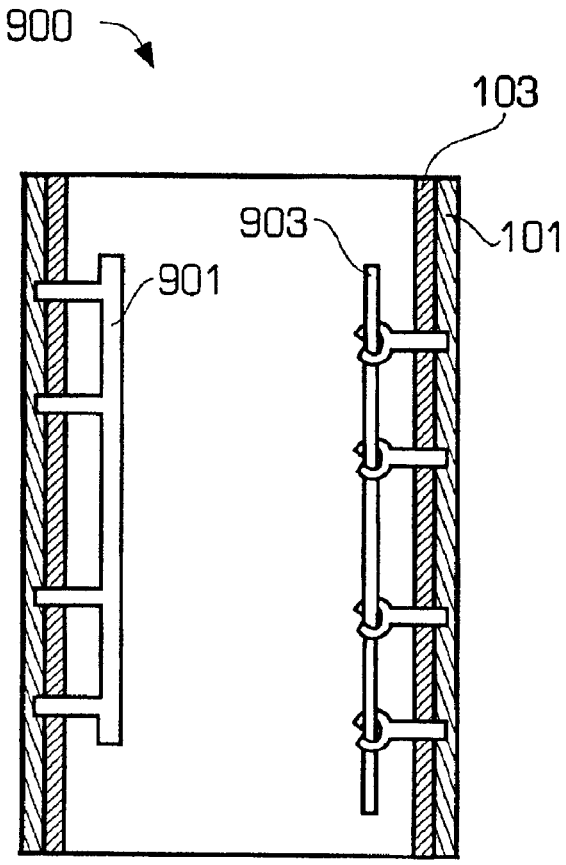
FIG. 9 is a cross-sectional inner view of a second alternate embodiment of the stay-in-place-form in accordance with the present invention.
Figure 10:
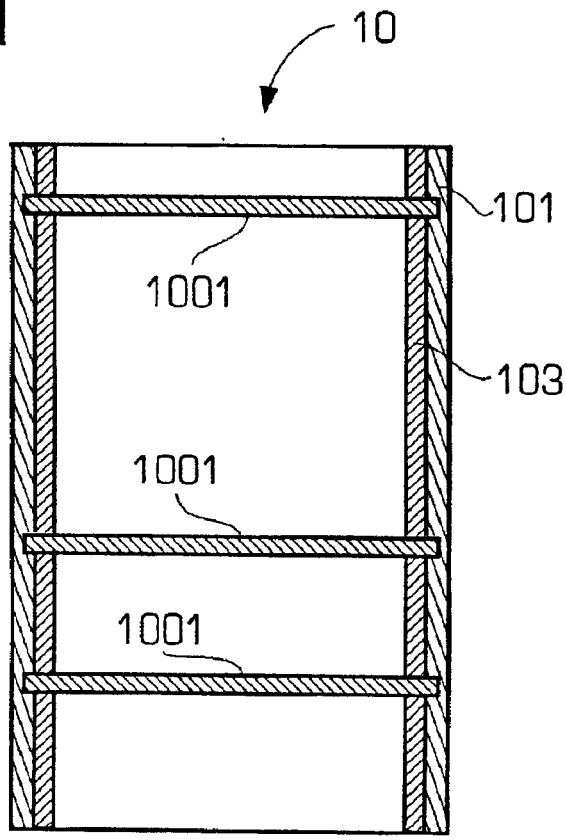
FIG. 10 is a cross-sectional inner view of a third alternate embodiment of the stay-in-place-form in accordance with the present invention.

As shown in FIG. 8, vertically extending reinforcing bars 801, 809 may extend a partial length of composite shell 101. Alternatively, referring to the cross-section view of stay-in-place form 900 illustrated in FIG. 9, vertically extending bars 901, 903 may extend along a substantial length of composite shell 101. Also, referring to the cross-section view of stay-in-place form 10 illustrated in FIG. 10, reinforcing bars 1001 may extend across the enclosure within stay-in-place form. It also will be appreciated that although reinforcing bars are illustrated as vertically and horizontally reinforcement bars in FIGS. 8–10, reinforcement bars can be situated in other positions, such as diagonally or circumferentially.

Figure 11A:
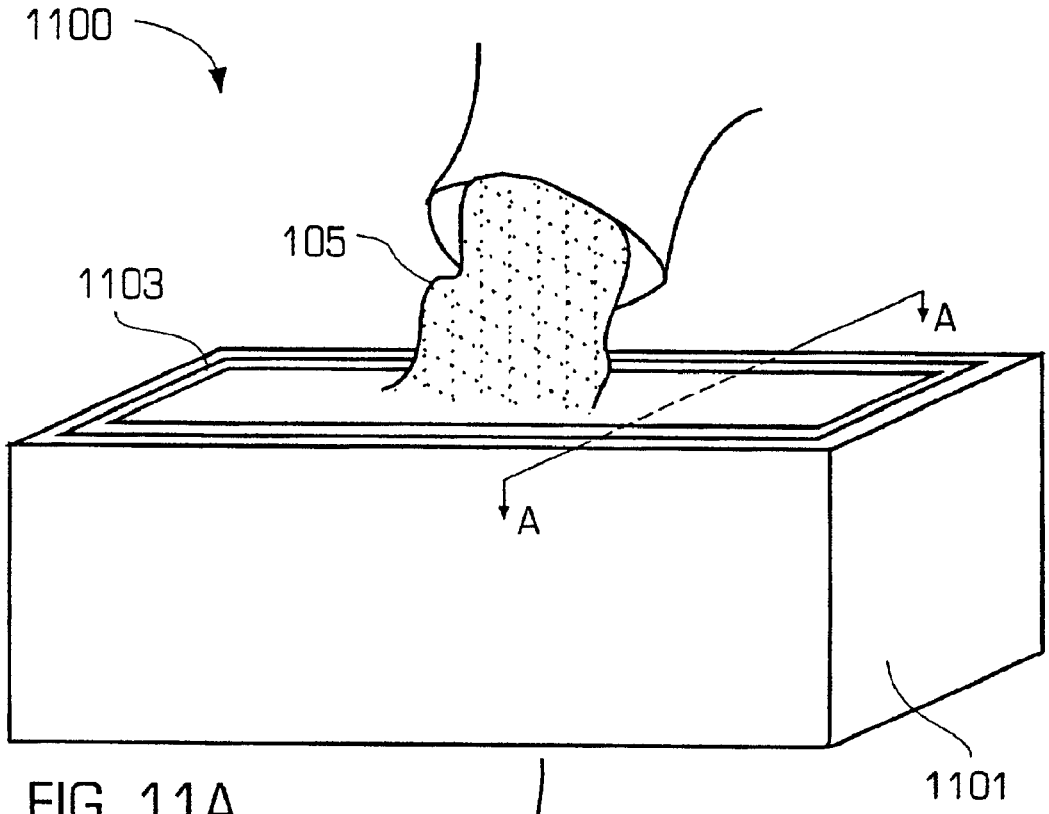
FIGS. 11A and 11B are a perspective longitudinal view and a cross-sectional inner view, respectively, illustrating a fourth alternate embodiment of the stay-in-place form in accordance with the present invention.

Stay-in-place forms 100 and 800, illustrated in FIGS. 1 and 8 respectively, have been disclosed as complete tubular or columnar enclosures. However, stay-in-place forms may also be partial enclosures. FIG. 11A illustrates a perspective view of a stay-in-place form 1100 that has a horizontally extending hollow rectangular channel shape. Stay-in-place form 800 includes a horizontally extending hollow channel composite shell 1101 and a liner 1103 secured to the inner surface of composite shell 1101. In this way, stay-in-place form 1100 provides a channel form into which a slurry of concrete or cement material 105 is placed, which upon hardening, creates a fully reinforced support structure. With this configuration, stay-in-place form 1100 only partially surrounds a concrete core and may be used, for example, to construct beams. Since the upper portion of the channel shaped stay-in-place form 1100 is open, the beam can easily connect to another support structure (not shown).

Figure 11B:
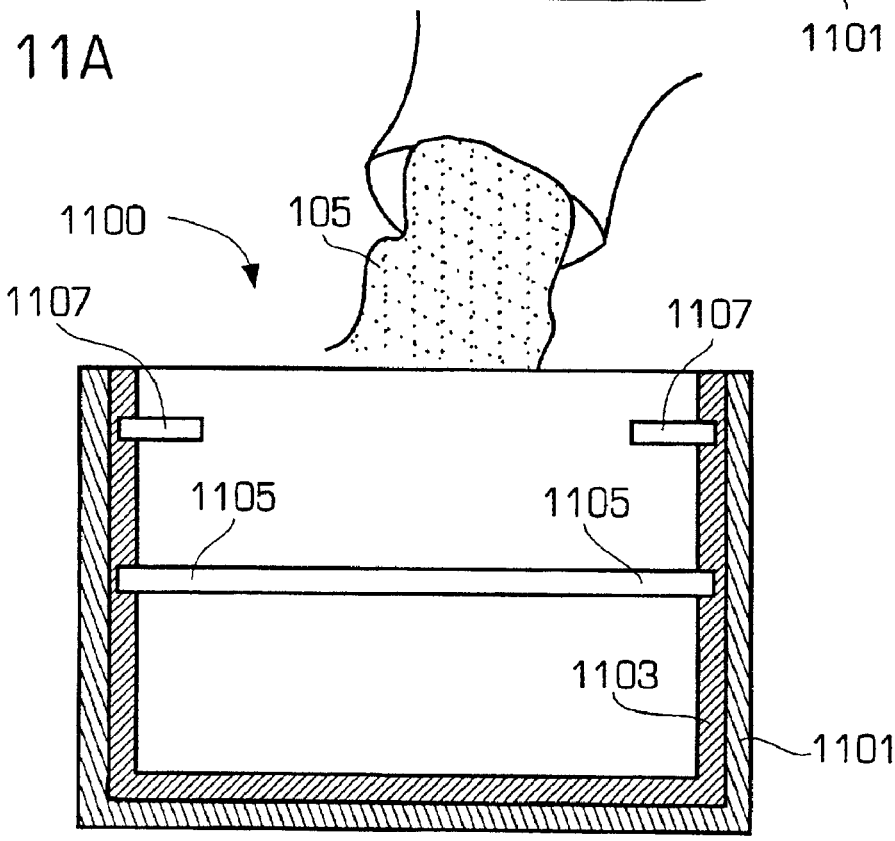

Referring now to FIG. 11B, a cross-sectional view of stay-in-place form 1100 along line A—A is illustrated. As shown in FIG. 11B, stay-in-place form 1100 includes reinforcement bars 1105 that extend across the width of the channel-shaped composite shell 1101, to provide additional reinforcement. In addition, stay-in-place form 1100 also includes built-in connectors 1107, which may be made of various materials such as fiber composite, steel, etc., formed into composite shell 1101 to connect the completed beam with another support structure, such as a column, foundation or other beam. Stay-in-place form 1100 may also include anchors at the edges or other areas of composite shell 1101 to further reinforce the completed support structure. In all of these embodiments, reinforcement bars 1105 and anchors 1107 are designed to withstand the stresses of concrete slurry 105 that is to be poured into the enclosure.

Stay-in-place forms 100, 800, 900, 1000, 1100 can be used as a cast-in-place structural member where the construction of the stay-in-place form is done at or near a construction site. Alternatively, stay-in-place forms 100, 800, 900, 1000, 1100 can be used as precast members, where construction of the stay-in-place form is done in a factory and is then shipped to the construction site.

Method of Manufacturing Stay-In-Place Form

Figure 12A:
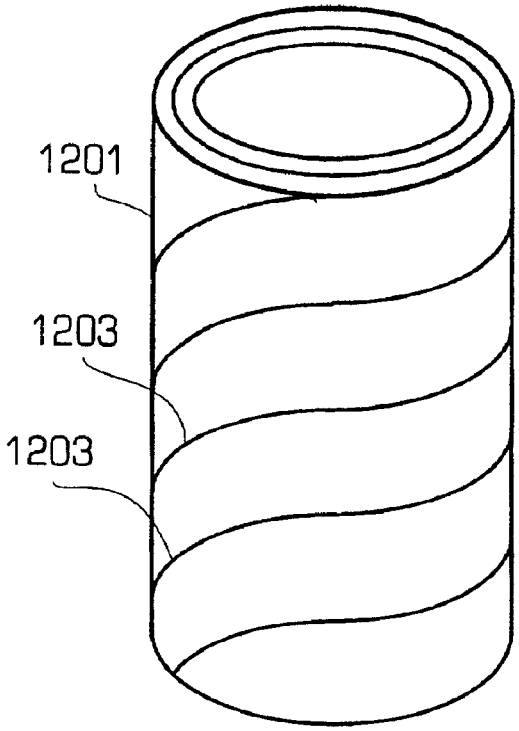
FIGS. 12A–12J are perspective views illustrating the steps of manufacturing a precast stay-in-place form constructed in accordance with the present invention.

FIGS. 12A–12J illustrate the sequence of steps employed to fabricate stay-in-place form 100 using a reusable form 1201 such as that illustrated in FIG. 12A. Care should be taken in selecting the shape of reusable form 1201, as the shape of reusable form 1201 will determine the shape of resulting stay-in-place form 100. In the embodiment illustrated in FIG. 12A, reusable form 1201 is a tubular form. In this FIG. 12A a perspective view of tubular form 1201 is shown. In an exemplary embodiment, tubular form 1201 is fabricated from a fiber paper which is formed by spirally winding and laminating the fiber paper together with a special adhesive along seams 1203. Although, tubular form 1201 is fabricated from fiber paper, it will be appreciated that tubular form 1201 can be fabricated from other types of material so long as tubular form 1201 is rigid and collapsible.

Figure 12B:
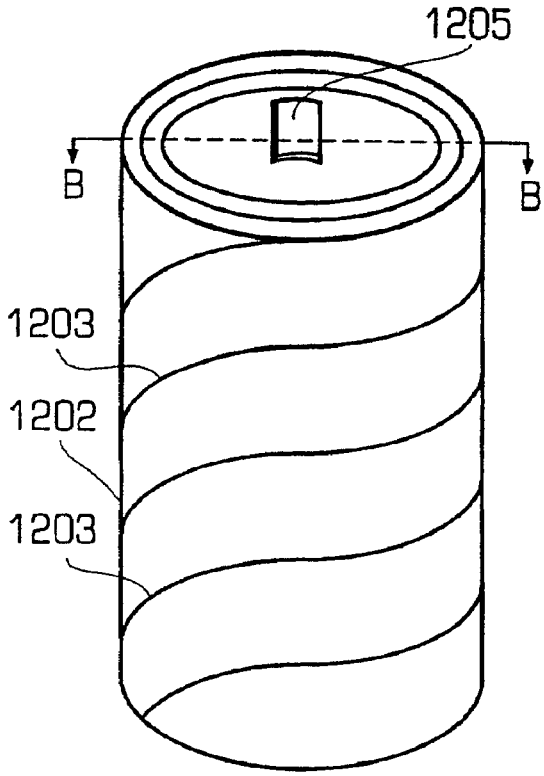
Figure 12C:
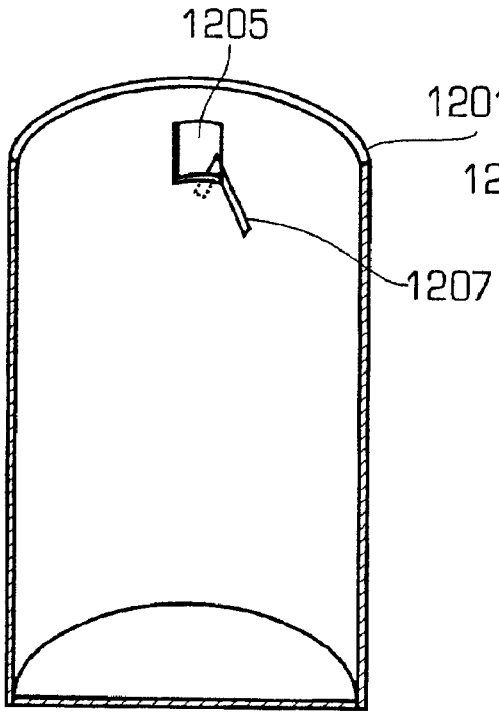
Figure 12D:
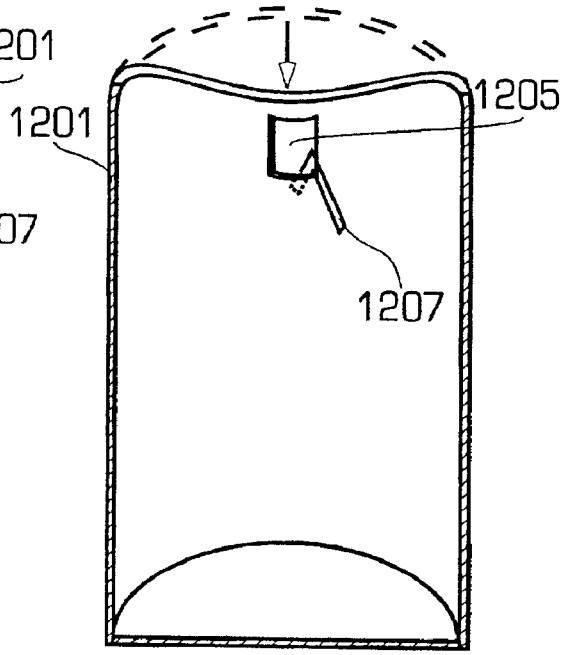

A small slit or groove 1205 is cut into the inner surface of tubular form 1201, as illustrated in FIG. 12B. Referring now to FIGS. 12C and 12D, a cross-sectional view of tubular form 1201 is shown along line B—B. As shown in FIG. 12C, a tool 1207 such as a steel blade, is able to grasp the small slit 1205. This enables a portion of tubular form 1201 to be pulled inward as illustrated in FIG. 12D, thereby reducing the diameter of tubular form 1201. The importance of this collapsing of tubular form 1201 will be explained later in the specification.

Figure 12E:
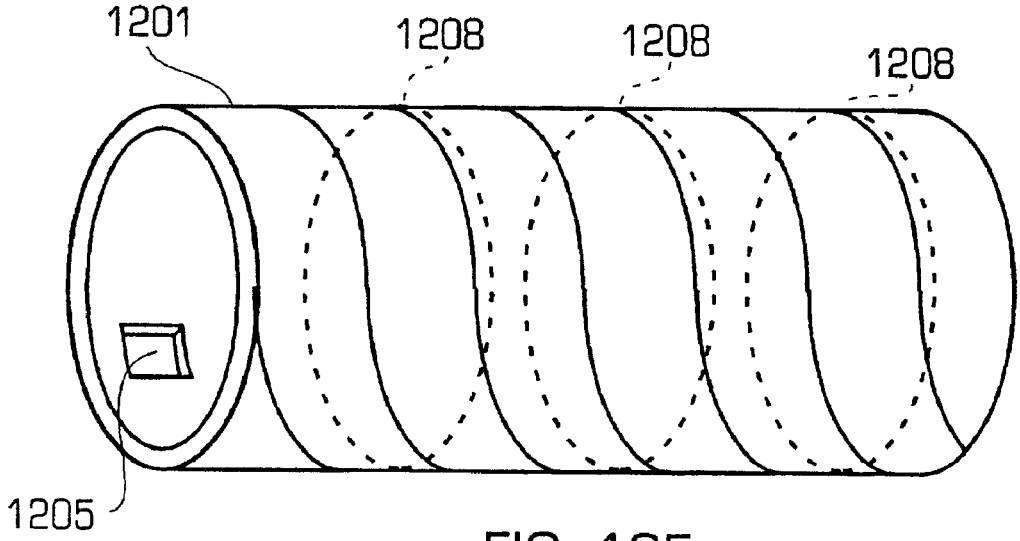

FIG. 12E illustrates a perspective view of tubular form 1201 lying on its side. Water bags 1208, illustrated with phantom lines, may be placed inside tubular form 1201 to maintain the shape of tubular form 1201 during the fabrication process of stay-in-place form 100. It will be appreciated that although water bags 1208 are illustrated to maintain the shape of tubular form 1201, it will be appreciated that other devices, such as mechanically expandable wood or steel, placed at the ends of tubular form 1201, can be used for the same purpose.

Figure 12F:
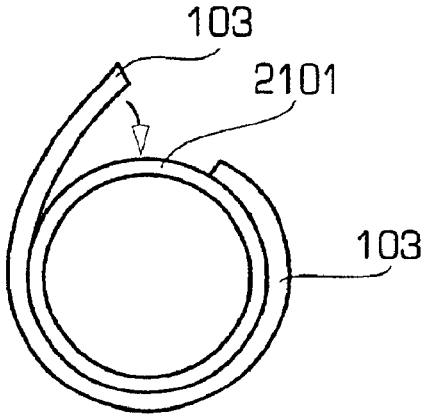

Once water bags 1208 have been inserted into tubular form 1201, liner 103 is applied to tubular form 1201. FIG. 12F, illustrates a top plan view of liner 103 being applied to the outer surface of tubular form 1201. Liner 103 is wrapped tightly around tubular form 1201 such that the lateral edges of liner 103 overlap and are held together with an adhesive material such as tape or glue. In some instances it is desirable to prevent at least one end of liner 103 from slipping relative to tubular form 1201. In such instances, liner 103 may be adhered to tubular form 1201, such as by applying tape, glue or some other adhesive material to liner 103, tubular form 1201 or both.

Figure 12H:
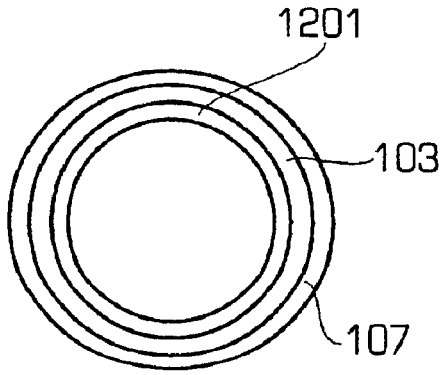
Figure 12G:
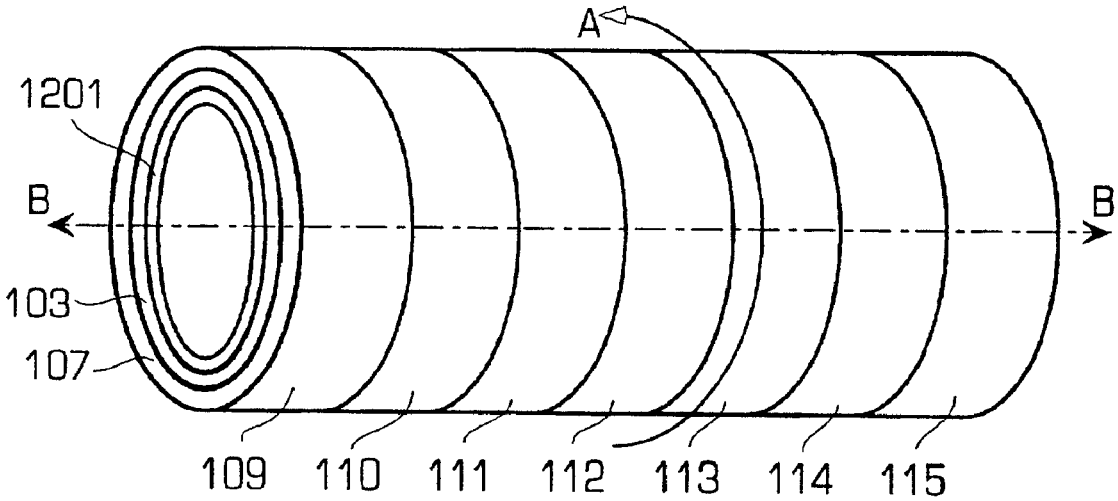

Once liner 103 has been wrapped around tubular form 1201, a composite reinforcement layer 107, as illustrated in FIG. 1, is applied to the exposed outer surface of liner 103, as illustrated in FIG. 12G. As explained above in reference to reinforcement layer 107, such reinforcement layer may be applied in a variety of different patterns and may be made up of multiple layers of fabric.

In the exemplary embodiment illustrated in FIG. 1, composite reinforcement layer 107 is made up of fabric layers 109–115. All of the fabric layers 109–115 must be impregnated with a resin in order to function properly in accordance with the present invention. Preferably, the resin is impregnated into the fabric prior to application to the exterior surface of liner 103. However, if desired, the resin may be impregnated into the fabric after the fabric is wrapped around the liner.

Figure 13:
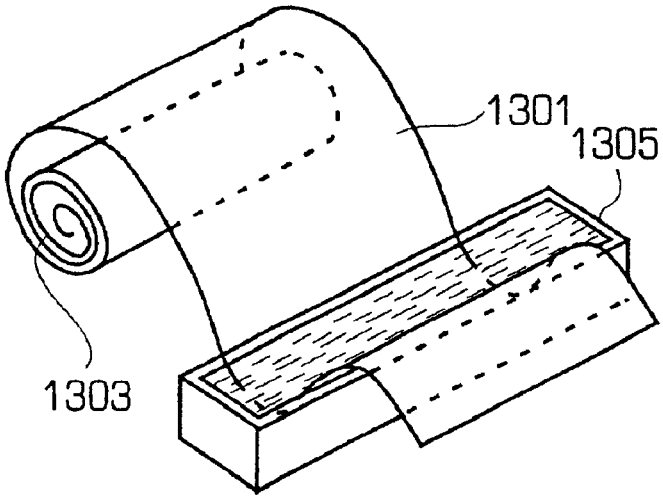
FIG. 13 is a demonstrative representation depicting the impregnation of a fabric layer prior to application to the tubular form in accordance with the present invention.

As illustrated in FIGS. 12G–12H, fabric layers 109–115 are resin impregnated prior to application to liner 103 so that the final fabric layers 109–115 are provided within a resin matrix. For example, referring to FIG. 13, a fabric 1301 is shown being unwound from roll 1303 and dipped in resin 1305 for impregnation prior to application to liner 103. Once a sufficient length of fabric 1301 has been impregnated with resin 1305, the impregnated fabric layer is cut from roll 1303 and is applied to the exterior surface of liner 103, as shown in FIGS. 12G–12H. The length of impregnated fabric is chosen to provide either one wrapping or multiple wrappings of liner 103. Once in place, the resin impregnated fabric layer is allowed to cure to form the composite reinforcement layer 107.

In an alternate embodiment, fabric layers 109–115 are impregnated with resin after being wrapped around liner 103. In either embodiment, it is preferable that tubular form 1201 be rotated around an axis B in a direction indicated by arrow A, as shown in FIG. 12G, while the fabric layers are wrapped around liner 103. Such rotation maintains the form of tubular form 1201 and ensures that the resin is uniformly distributed. Tubular form 1201 may be suspended or rotated on a platform while this rotation takes place. The rotation of tubular form 1201 continues until the resin impregnated fabric layers are fully cured.

Curing of the resins is carried out in accordance with well known procedures which will vary depending upon the particular resin matrix used. The various catalysts, curing agents and additives which are typically employed with such resin systems may be used. The amount of resin which is impregnated into the fabric is preferably sufficient to saturate the fabric.

Figure 12I:
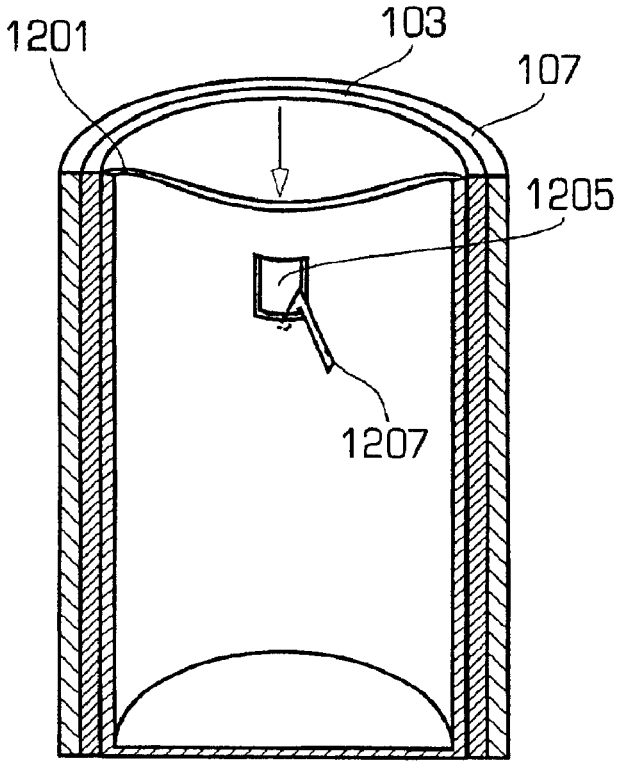
Figure 12J:
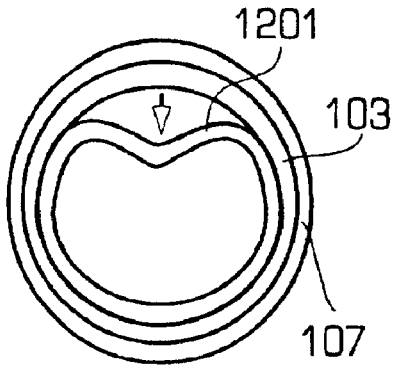

Once the fabric layers are fully cured, tubular form 1201 is pulled out from liner 103. One technique for removing tubular form 1201 is to use a release tool 1207, such as a steel blade, as illustrated in FIGS. 12C–12D. Release tool 1207 is inserted into slit 1205 as illustrated in FIG. 12C. Pulling on release tool 1207, causes a portion of tubular form 1201 to be pulled inward and away from liner 103, thereby reducing the diameter of the form 1201, as shown in FIGS. 12D. FIGS. 12I–12J further illustrate the collapsing of tubular form 1201. FIG. 12I illustrates a cross-sectional view along line B of liner 103 and composite reinforcement layer 107 wrapped around tubular form 1201 as shown in FIG. 12G. FIG. 12J illustrates a top plan view of tubular form 1201 being collapsed inward and away from liner 103. Using this technique, tubular form 1201 can be collapsed and pulled out from beneath liner 103. Once tubular form 1201 is pulled out, the resulting structure is stay-in-place form 100, illustrated in FIG. 1.

Figure 14:
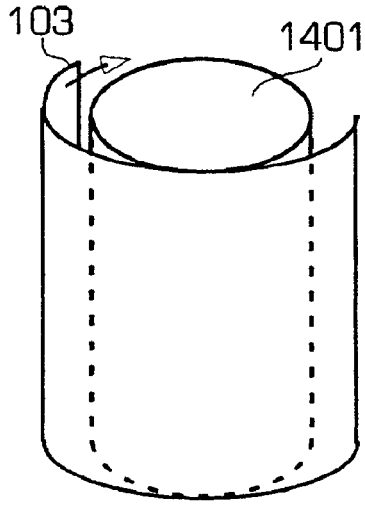
FIG. 14 is a perspective view illustrating application of a liner to a mandrel in accordance with the present invention.

In an alternate embodiment, stay-in-place form 100 is formed using a mandrel, as illustrated in FIG. 14A. In such an embodiment, mandrel 1401 serves as a core around which liner 103 is wrapped, as illustrated in FIG. 14A. Composite reinforcement layer 107 impregnated with the resin is then continuously wrapped around liner 103 until a desired thickness is obtained, as illustrated in FIGS. 12G and 12H. Once the fibers are cured, liner 103 and the hardened shell formed from composite reinforcement layer 107 are slipped off mandrel 1401. In either embodiment, the resulting structure is stay-in-place form 100.

Various other modifications and alterations in the structure and method of operation of this invention will be apparent to those skilled in the art without departing from the scope and spirit of this invention. Although the invention has been described in connection with specific preferred embodiments, it should be understood that the invention as claimed should not be unduly limited to such specific embodiments.

What is claimed is:

1. A method of manufacturing a stay-in-place composite shell, the method comprising:

applying a liner to an exterior surface of a tubular member, the liner including at least one sheet of a water-impermeable material;

applying a fabric layer having a plurality of fibers to the liner;

impregnating the fabric layer with a resin matrix to form a resin-impregnated fabric layer; and removing the tubular member once the resin matrix cures to form a composite shell having an inner wall surface defining an enclosure into which concrete may be poured and allowed to harden, wherein the plurality of fibers are capable of elongating in the event that concrete is poured into the enclosure of the composite shell due to a weight of the concrete, and partially shrinking back as the concrete dries to compensate for shrinkage of the concrete, and wherein the liner protects the composite shell from alkalinity in the concrete.

2. The method of claim 1, wherein the of applying a fabric layer to the liner comprises:

suspending the tubular member with the liner applied to the exterior surface of the tubular member; and rotating the tubular member while wrapping the fabric layer around the liner.

3. The method of claim 1, wherein the plurality of fibers are selected from the group consisting of glass, carbon, graphite, polyaramid, boron, Kevlar, silica, quartz, ceramic, polyethylene, and aramid.

4. The method of claim 1, wherein the liner comprises one of the group consisting of plastic, natural rubber, polystyrene, vinyl, polyethylene, chlorosulfonated polyethylene, synthetic rubber, ethylene-propylene-diene (EPDM) terpolymer, and other resistive materials.

5. The method of claim 1, wherein the plurality of fibers have a lesser percent of elongation than the resin matrix.

6. The method of claim 5, wherein a percent of elongation of the plurality of fibers and resin matrix is adapted to prevent a gap from forming between the concrete core formed in the enclosure and the composite shell, when the concrete shrinks.

7. The method of claim 1, further comprising:

providing an anchor extending into the composite shell and projecting into the enclosure of the composite shell; and affixing a reinforcing bar to the composite shell for strengthening the stay-in-place form by coupling the reinforcing bar to the anchor.

8. The method of claim 7, wherein the reinforcing bar comprises a fiber composite.

9. The method of claim 7, wherein the reinforcing bar comprises steel.

10. A method of manufacturing a stay-in-place composite shell, the method comprising:

wrapping a water-impermeable liner around a mandrel;

wrapping a fabric layer having a plurality of fibers, around an exterior surface of the water-impermeable liner;

impregnating the fabric layer with a resin matrix; and separating the mandrel from the water-impermeable liner and fabric layer once the resin matrix cures, to form a composite shell having an inner wall surface defining an enclosure into which concrete may be poured and allowed to harden to form a concrete core, wherein the plurality of fibers are capable of elongating in the event that concrete is poured into the enclosure of the composite shell due to a weight of the concrete, and partially shrinking back as the concrete dries to compensate for shrinkage of the concrete, and wherein the water-impermeable liner is wrapped with its lateral edges secured together to line an inner wall surface of the composite shell and protects the composite shell from alkalinity in the concrete core.

11. The method of claim 10, further comprising:

rotating the mandrel about a center axis while wrapping a fabric layer impregnated with a resin matrix and having a plurality of fibers, around an exterior surface of the water-impermeable liner.

12. A method of manufacturing a stay-in-place composite shell, the method comprising:

wrapping a water-impermeable liner around an exterior surface of a reusable form;

rotating the reusable form about an axis while applying a fabric layer impregnated with a resin matrix and having a plurality of fibers, to the exterior surface of the water-impermeable liner; and removing the reusable form once the resin matrix cures, to form a composite shell having an inner wall surface defining an enclosure into which concrete may be poured and allowed to harden to form a concrete core, wherein the plurality of fibers are capable of elongating in the event that concrete is poured into the enclosure of the composite shell due to a weight of the concrete, and partially shrink back as the concrete dries to compensate for shrinkage of the concrete, and wherein the liner is wrapped with its lateral edges secured together to line an inner wall surface of the composite shell and protect the composite shell from alkalinity in the concrete core.

13. A method of manufacturing a stay-in-place composite shell, the method comprising:

applying a liner to an exterior surface of a tubular member, the liner including at least one sheet of a water-impermeable material;

applying a fabric layer having a plurality of fibers to the liner;

impregnating the fabric layer with a resin matrix to form a resin-impregnated fabric layer; and removing the tubular member once the resin matrix cures to form a composite shell having an inner wall surface defining an enclosure into which concrete may be poured and allowed to harden, wherein the step of removing the tubular member once the curable resin cures to form a composite shell having an inner wall surface defining an enclosure comprises:

cutting a slit in the tubular member;

pulling a portion of the tubular member inward at the slit to reduce the diameter of tubular member; and pulling the tubular member away from the liner to form a composite shell having an inner wall surface defining an enclosure.

* * * * *